US008659234B2

(12) United States Patent
Yang

(10) Patent No.: US 8,659,234 B2
(45) Date of Patent: Feb. 25, 2014

(54) ELECTRONIC CANDLE

(76) Inventor: Derek Yang, Hacienda Hts, CA (US)

( * ) Notice: Subject to any disclaimer, the term of this patent is extended or adjusted under 35 U.S.C. 154(b) by 99 days.

(21) Appl. No.: 13/442,794

(22) Filed: Apr. 9, 2012

(65) Prior Publication Data

US 2013/0264963 A1 Oct. 10, 2013

(51) Int. Cl.
*H05B 37/02* (2006.01)

(52) U.S. Cl.
USPC ..... 315/250; 315/291

(58) Field of Classification Search
None
See application file for complete search history.

(56) References Cited

U.S. PATENT DOCUMENTS

2004/0212322 A1* 10/2004 Rose ..... 315/291
2008/0198595 A1* 8/2008 Lai ..... 362/234
2008/0231210 A1* 9/2008 Baker Schwenk ..... 315/292

* cited by examiner

*Primary Examiner* — Crystal L Hammond
(74) *Attorney, Agent, or Firm* — Pai Patent & Trademark Law Firm; Chao-Chang David Pai

(57) ABSTRACT

An electronic candle includes a power source, and two circuit assemblies electrically coupled to the power source in parallel and respectively including a waveform generator, a drive circuit and a first light-emitting diode being electrically connected in series. By means of controlling the two waveform generators to respectively generate a triangle wave, square wave, T wave or sawtooth wave, synchronously or asynchronously, the electronic candle simulates the flashing candlelight of a real wax candle.

4 Claims, 4 Drawing Sheets

ELECTRONIC CANDLE

BACKGROUND OF THE INVENTION (a) Field of the Invention

The present invention relates to electronic candles and more particularly to an electronic candle driving circuit design, which effectively simulates the flashing candlelight of a real wax candle in the presence of an air flow.

(b) Description of the Prior Art

Conventional electronic candles use a lamp bulb as the light source. After a long use, the brightness of the lamp bulb may deteriorate and become dim. Nowadays, power-saving light-emitting diodes have been widely used in electronic candles to replace conventional lamp bulbs for the advantage of long durability and constant brightness. There are electronic candles using a control circuit to control the supply of intermittent electric current to light-emitting diodes, thereby simulating the flaming of a real wax candle. However, because the circuit breaking time interval is very short, the intermittent lighting effect may be not significantly visible. Further, this intermittent lighting effect cannot simulate flying flickering flame. Further, the variation of lighting mode between high brightness and dimness is still not attractive. Improper operation control may result in an off status of light, thus losing the sense of the electronic candle. Therefore, there is a strong demand for an electronic candle that eliminates the aforesaid drawbacks.

SUMMARY OF THE INVENTION

The objective of the present invention is to provide an electronic candle, which effectively simulates the flashing candlelight of a real wax candle.

To achieve this and other objects of the present invention, an electronic candle according to the present invention comprises a power source, a first circuit assembly and a second circuit assembly electrically coupled to the power source in parallel. The first circuit assembly comprises a first waveform generator controllable to generate a first waveform, a first drive circuit electrically connected to the first waveform generator, and a first light-emitting diode electrically connected in series to the first drive circuit and the first waveform generator and drivable by the first drive circuit to emit light in a first lighting mode subject to the first waveform. The second circuit assembly comprises a second waveform generator controllable to generate a second waveform, a second drive circuit electrically connected to the second waveform generator, and a second light-emitting diode electrically connected in series to the second drive circuit and the second waveform generator and drivable by the second drive circuit to emit light in a second lighting mode subject to the second waveform.

To achieve this and other objects of the present invention, an alternate form of the electronic candle comprises a power source, a first circuit assembly and a second circuit assembly electrically coupled to the power source in parallel. The first circuit assembly comprises a first waveform generator controllable to generate a first waveform, a first pulse wave generator controllable to generate a first pulse-width modulation signal, a first wave mixer electrically coupled with the first waveform generator and the first pulse wave generator and adapted for mixing the first waveform and the first pulse-width modulation signal, a first drive circuit electrically connected to the first wave mixer, and a first light-emitting diode electrically connected to the first drive circuit and drivable by the first drive circuit to emit light in a first lighting mode. The second circuit assembly comprises a second waveform generator controllable to generate a second waveform, a second pulse wave generator controllable to generate a second pulse-width modulation signal, a second wave mixer electrically coupled with the second waveform generator and the second pulse wave generator and adapted for mixing the second waveform and the second pulse-width modulation signal, a second drive circuit electrically connected to the second wave mixer, and a second light-emitting diode electrically connected to the second drive circuit and drivable by the second drive circuit to emit light in a second lighting mode.

Further, the first waveform generator is controllable to generate one of triangle wave, square wave, T wave and sawtooth wave.

Further, the second waveform generator is controllable to generate one of triangle wave, square wave, T wave and sawtooth wave.

Further, the waveforms generated by the first waveform generator and the second waveform generator have a frequency difference and an amplitude difference.

By means of controlling the two light-emitting diodes to emit light in different lighting modes, a visual decussation effect is produced, and thus the electronic candle can simulate the flashing candlelight of a real wax candle in an air flow.

Other advantages and features of the present invention will be fully understood by reference to the following specification in conjunction with the accompanying drawings, in which like reference characters denote like components of structure.

DETAILED DESCRIPTION OF THE PREFERRED EMBODIMENTS

Figure 1:
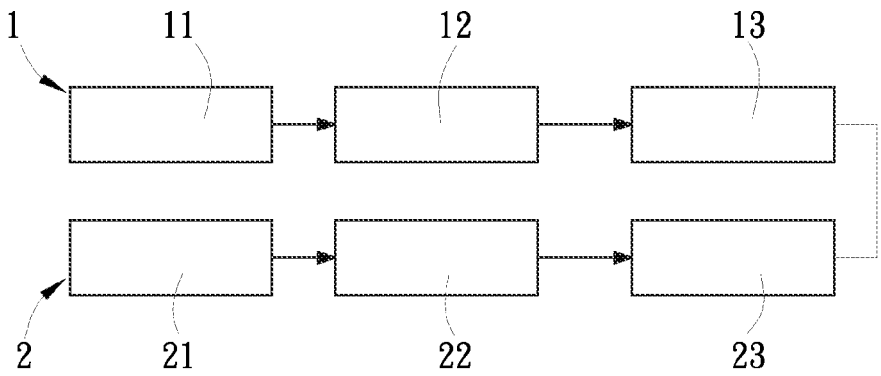
FIG. 1 is a circuit block diagram of an electronic candle in accordance with a first embodiment of the present invention.
Figure 2:
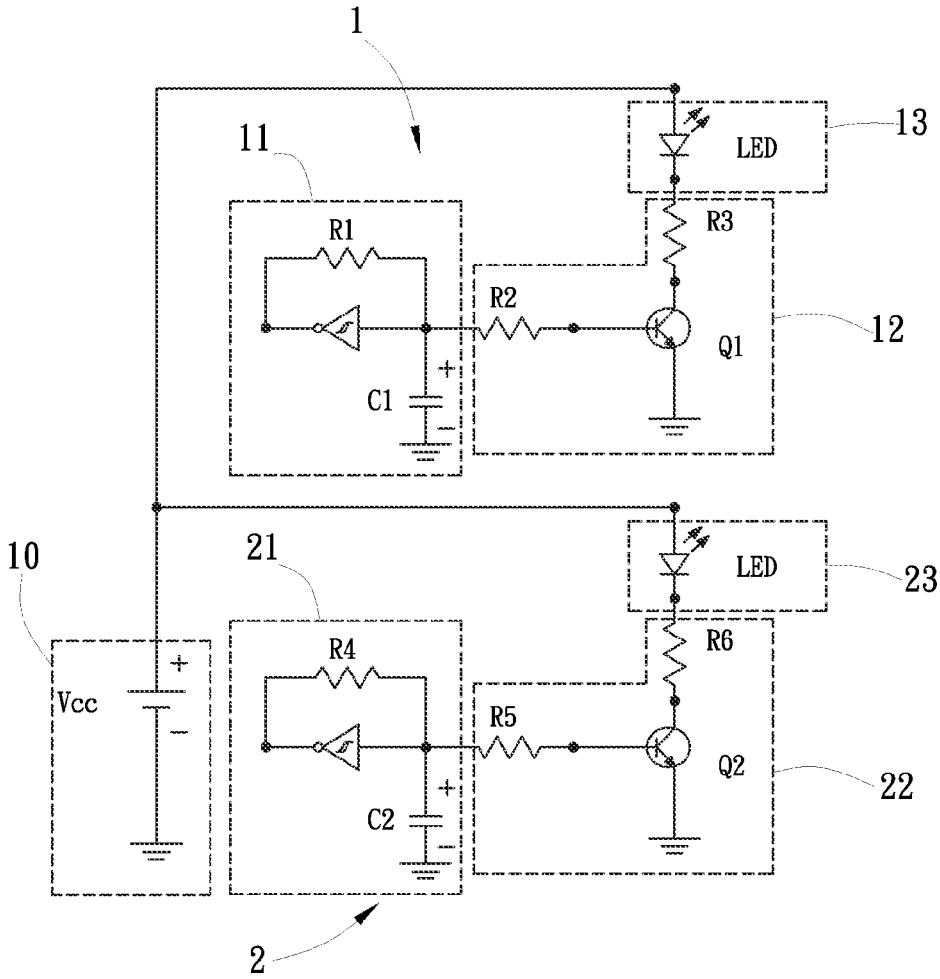
FIG. 2 is a detailed circuit diagram of the electronic candle in accordance with the first embodiment of the present invention.

As shown in FIGS. 1 and 2, an electronic candle in accordance with a first embodiment of the present invention comprises a first circuit assembly 1 and a second circuit assembly 2 that are connected in parallel to a power source 10. The second circuit assembly 2 is adapted to generate a waveform different from that generated by the first circuit assembly 1. For example, the first circuit assembly 1 can be designed to generate square wave; the second circuit assembly 2 can be designed to generate another full wave. The first circuit assembly 1 comprises a first waveform generator 11, a first drive circuit 12 and a first light-emitting diode 13 that are connected in series. The second circuit assembly 2 comprises a second waveform generator 21, a second drive circuit 22 and a second light-emitting diode 23 that are connected in series. The waveform outputted by the first waveform generator 11 (see FIG. 3 or FIG. 6) and the waveform outputted by the second waveform generator 21 (see FIG. 4 or FIG. 7) can be the same but asynchronous. Alternatively, these two waveforms can be different but synchronously outputted.

Figure 5:
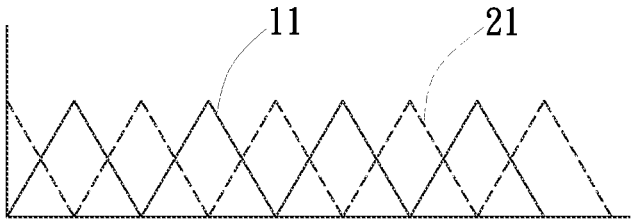
FIG. 5 is a schematic drawing illustrating two waveforms respectively outputted by the first waveform generator and the second waveform generator and overlapped according to the present invention.
Figure 8:
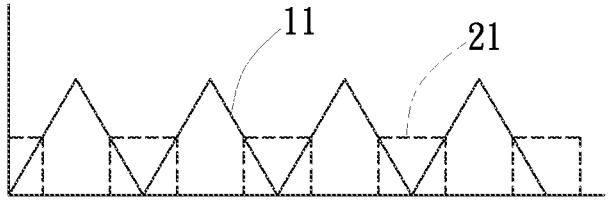
FIG. 8 is a schematic drawing illustrating two different waveforms respectively outputted by the first waveform generator and the second waveform generator and overlapped according to the present invention.

During operation of the aforesaid electronic candle, the first waveform generator 11 outputs a first waveform to the first drive circuit 12, causing the first light-emitting diode 13 to create a first lighting effect subject to the waveform outputted by the first waveform generator 11; the second waveform generator 21 outputs a second waveform to the second drive circuit 22, causing the second light-emitting diode 23 to create a second lighting effect subject to the waveform outputted by the second waveform generator 21. As the first waveform and the second waveform are different (same waveform but asynchronous, or different waveforms but synchronous), the first light-emitting diode 13 and the second light-emitting diode 23 are driven to emit different lighting frequencies, as shown in FIG. 5 and FIG. 8.

Figure 3:
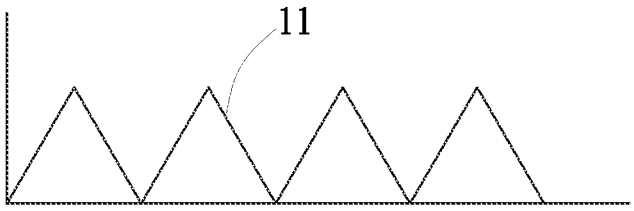
FIG. 3 illustrates a triangle wave generated by the first waveform generator of the electronic candle in accordance with the present invention.
Figure 4:
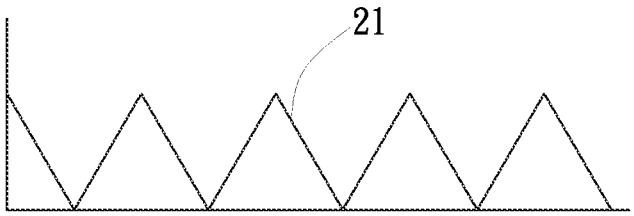
FIG. 4 illustrates a triangle wave generated by the second waveform generator of the electronic candle in accordance with the present invention.
Figure 6:
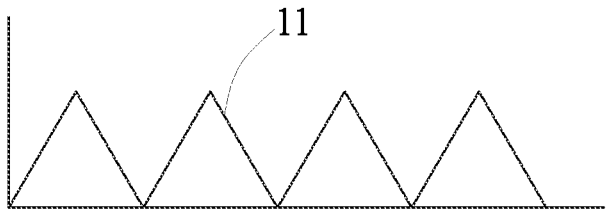
FIG. 6 is a schematic drawing illustrating another triangle wave generated by the first waveform generator of the electronic candle in accordance with the present invention.
Figure 7:
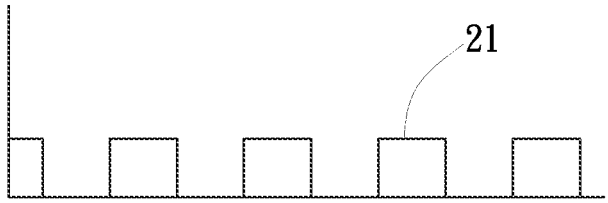
FIG. 7 is a schematic drawing illustrating a square wave generated by the second waveform generator of the electronic candle in accordance with the present invention.

Referring to FIG. 3 and FIG. 4, the first waveform generator 11 and the second waveform generator 21 can be set to output triangle waves asynchronously. Alternatively, as shown in FIG. 6 and FIG. 7, the first waveform generator 11 and the second waveform generator 21 can be set to output a triangle wave and a square wave in a synchronous manner. In other words, these two waveform generators can be designed to output triangle wave, square wave, T-wave or sawtooth wave in a time difference or density difference for causing an unstable flashing effect. These two waveform generators can also be set to output a triangle wave and a square wave, a T-wave and a square wave, or a triangle wave and a T-wave respectively, and so on. Even the two waveform generators output the same waveform, a time interval difference can lead to a brightness difference. When the brightness of the two light-emitting diodes is enhanced at a different frequency, a flashing effect will also be produced. By means of waveform variation, a flickering, gradually brightening or gradually dimming lighting effect can be produced.

Figure 9:
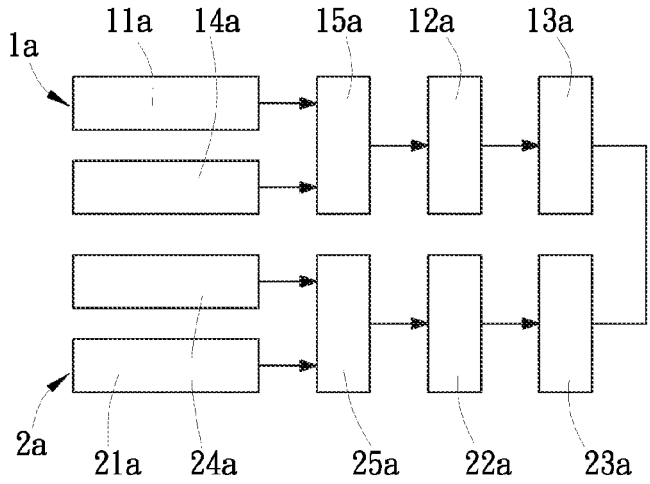
FIG. 9 is a circuit block diagram of an electronic candle in accordance with a second embodiment of the present invention.
Figure 10:
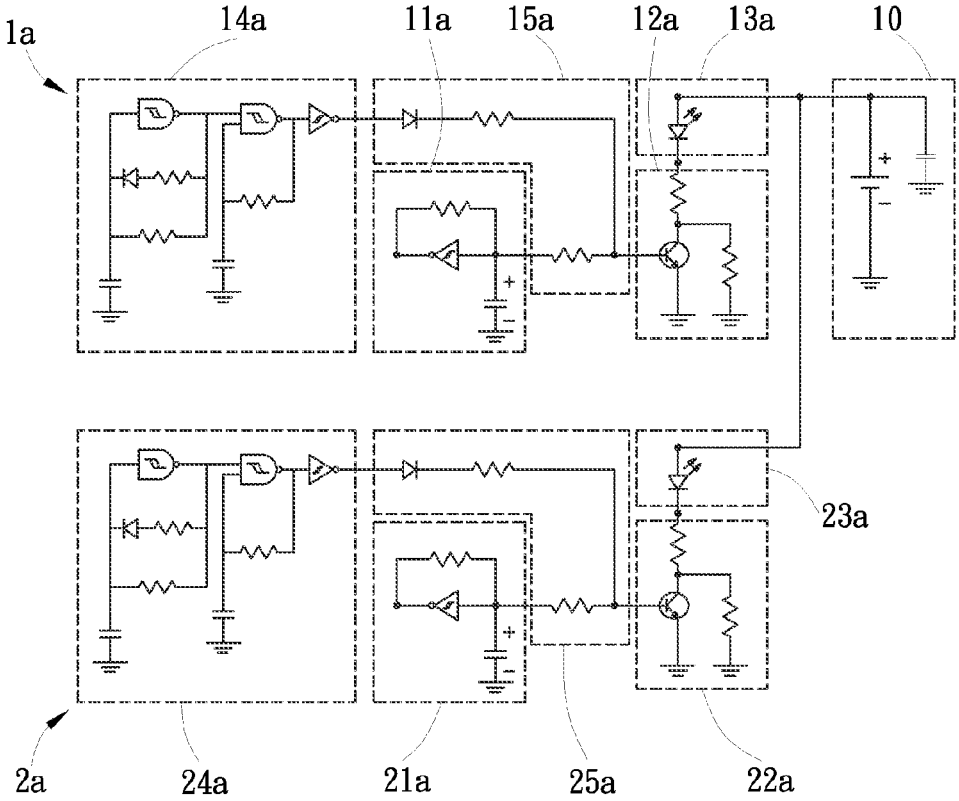
FIG. 10 is a detailed circuit diagram of the electronic candle in accordance with the second embodiment of the present invention.

An electronic candle in accordance with a second embodiment of the present invention is shown in FIGS. 9 and 10. The electronic candle of this second embodiment comprises a first circuit assembly la and a second circuit assembly 2*a* that are connected in parallel to a power source 10. The first circuit assembly la comprises a first waveform generator 11*a*, a first drive circuit 12*a*, a first light-emitting diode 13*a*, a first pulse wave generator 14*a*, and a first wave mixer 15*a*. The output end of the first waveform generator 11*a* and the output end of the first pulse wave generator 14*a* are connected in parallel to the first wave mixer 15*a*. The first wave mixer 15*a* is connected in series to the first drive circuit 12*a* and the first light-emitting diode 13*a*. The second circuit assembly 2*a* comprises a second waveform generator 21*a*, a second drive circuit 22*a*, a second light-emitting diode 23*a*, a second pulse wave generator 24*a*, and a second wave mixer 25*a*. The output end of the second waveform generator 21*a* and the output end of the second pulse wave generator 24*a* are connected in parallel to the second wave mixer 25*a*. The second wave mixer 25*a* is connected in series to the second drive circuit 22*a* and the second light-emitting diode 23*a*.

Further, the first waveform generator 11*a* is adapted to generate a triangle wave, square wave, T-wave or sawtooth wave and to output the generated waveform into the first wave mixer 15*a*. The first pulse wave generator 14*a* is adapted to generate a PWM (pulse width modulation) signal and to output the generated PWM signal into the first wave mixer 15*a*. The first wave mixer 15*a* is adapted to convert the waveform generated by the first waveform generator 11 a into a signal wave subject to the PWM signal received from the first pulse wave generator 14*a*, and then to output the signal wave to the first drive circuit 12*a* for driving the first light-emitting diode 13*a*. The second circuit assembly 2*a* is adapted to generate a triangle wave, square wave, T-wave or sawtooth wave and to output the generated waveform into the second wave mixer 25*a*. The second pulse wave generator 24*a* is adapted to generate a PWM (pulse width modulation) signal and to output the generated PWM signal into the second wave mixer 25*a*. The second wave mixer 25*a* is adapted to convert the waveform generated by the second waveform generator 21*a* into a signal wave subject to the PWM signal received from the second pulse wave generator 24*a*, and then to output the signal wave to the second drive circuit 22*a* for driving the second light-emitting diode 23*a*.

The waveform outputted by the first waveform generator 11 and the waveform outputted by the second waveform generator 21 can be the same but asynchronous. Alternatively, these two waveforms can be different but synchronously outputted. Thus, the first waveform generated by the first waveform generator 11*a* can be modulated by the first wave mixer 15*a* subject to the PWM signal received from the first pulse wave generator 14*a*, and the second waveform generated by the second waveform generator 21*a* can be modulated by the second wave mixer 25*a* subject to the PWM signal received from the second pulse wave generator 24*a*.

The modulated waves from the first wave mixer 15*a* and the second wave mixer 25*a* are respectively provided to the first drive circuit 12*a* and the second drive circuit 22*a* to drive the first light-emitting diode 13*a* and the second light-emitting diodes 23*a*, causing the first light-emitting diode 13*a* and the second light-emitting diodes 23*a* to create different lighting effects. As the modulated first waveform and the modulated second waveform are different (same waveform but asynchronous, or different waveforms but synchronous), the first light-emitting diode 13*a* and the second light-emitting diode 23*a* are driven to emit different lighting frequencies, In conclusion, the invention provides an electronic candle, which uses two independent circuit assemblies to produce a waveform phase difference. When the waveform, frequency and amplitude are all different, many variations between the waveforms being outputted by the two circuit assemblies are generated. Thus, by means of controlling the waveform generators of the two circuit assemblies to generate a respective waveform at a respective frequency, the respective drive circuits drive the first light-emitting diode and the second light-emitting diode to perform a respective lighting mode, producing a highly variable lighting effect.

What is claimed is:

1. An electronic candle, comprising:

a power source;

a first circuit assembly electrically coupled to said power source, said first circuit assembly comprising a first waveform generator controllable to generate a first waveform, a first pulse wave generator controllable to generate a first pulse-width modulation signal, a first wave mixer electrically coupled with said first waveform generator and said first pulse wave generator and adapted for mixing said first waveform and said first pulse-width modulation signal, a first drive circuit electrically connected to said first wave mixer, and a first light-emitting diode electrically connected to said first drive circuit and drivable by said first drive circuit to emit light in a first lighting mode; and a second circuit assembly electrically coupled to said power source in parallel with said first circuit assembly, said second circuit assembly comprising a second waveform generator controllable to generate a second waveform, a second pulse wave generator controllable to generate a second pulse-width modulation signal, a second wave mixer electrically coupled with said second waveform generator and said second pulse wave generator and adapted for mixing said second waveform and said second pulse-width modulation signal, a second drive circuit electrically connected to said second wave mixer, and a second light-emitting diode electrically connected to said second drive circuit and drivable by said second drive circuit to emit light in a second lighting mode.

2. The electronic candle as claimed in claim 1, wherein said first waveform generator is controllable to generate one of triangle wave, square wave, T wave and sawtooth wave.

3. The electronic candle as claimed in claim 2, wherein said second waveform generator is controllable to generate one of triangle wave, square wave, T wave and sawtooth wave.

4. The electronic candle as claimed in claim 3, wherein the waveforms generated by said first waveform generator and said second waveform generator have a frequency difference and an amplitude difference.

* * * * *